US006808401B2

(12) United States Patent
Guzeldereli et al.

(10) Patent No.: US 6,808,401 B2
(45) Date of Patent: Oct. 26, 2004

(54) EJECTOR FOR ELECTRICAL CONNECTOR

(76) Inventors: Yasin Guzeldereli, 9513 W. 31st St., Brookfield, IL (US) 60525; Alan S. Walse, 455 Sunset Ave., La Grange, IL (US) 60525

( * ) Notice: Subject to any disclaimer, the term of this patent is extended or adjusted under 35 U.S.C. 154(b) by 0 days.

(21) Appl. No.: 10/376,200

(22) Filed: Feb. 28, 2003

(65) Prior Publication Data

US 2004/0171290 A1 Sep. 2, 2004

(51) Int. Cl.[7] ..... H01R 13/62
(52) U.S. Cl. ..... 439/160; 439/923
(58) Field of Search ..... 439/160, 152, 439/159, 155, 923

(56) References Cited

U.S. PATENT DOCUMENTS 4,614,015 A * 9/1986 Nagare et al. ..... 439/152
4,821,392 A * 4/1989 Layland, Jr. ..... 439/160
5,679,014 A * 10/1997 Lan-Jen ..... 439/160
5,964,605 A 10/1999 Heydorn et al.
6,015,308 A * 1/2000 Lee et al. ..... 439/155

FOREIGN PATENT DOCUMENTS

DE 004235987 A1 * 2/1994 ..... 439/160

* cited by examiner

*Primary Examiner*—P. Austin Bradley
*Assistant Examiner*—Felix O. Figueora
(74) *Attorney, Agent, or Firm*—Dennis A. Gross; The Hill Firm

(57) ABSTRACT

A manually actuated ejector for electrical connectors for providing an initial disconnection movement between connector components includes a pivotal lever attached to one connector component having an actuator link connected thereto, the link terminating in a connection to a rotatable cam carried by the one connector part with a cam face in juxtaposition to an opposed surface of a second connector part whereby movement of the lever rotates the cam in opposition to the second connector part causing relative disconnection movement between the two connector parts.

5 Claims, 1 Drawing Sheet

EJECTOR FOR ELECTRICAL CONNECTOR

BACKGROUND OF THE INVENTION

1. Field of the Invention

This invention relates to electrical connectors and more particularly to an ejector or disconnector mechanism for electrical connectors.

2. Prior Art

Electrical connectors, particularly large multi pin and socket connectors, when in proper seated connection, can be difficult to separate. Such multi pin and socket large connectors are commonly used, for example, on railroad equipment between engines or between engines and cars or between cars. Such connectors can be quite heavy and bulky and are required to be securely connected during operation. Although auxiliary retention or clamping structures may be provided to securely hold the connectors in connected relationship, the pin and socket connector sets themselves, in order to be electrically transmissive, must be in intimate physical contact pin to socket. This physical contact requirement by itself provides a frictional resistance to separation of the contact components. In addition, inconvenient locations for such connectors and environmental factors all contribute to making separation of the connectors difficult. Because of the desire to protect the connectors from damage, it is important to not use potentially damaging gripping tools during the disconnection process or to exert undue force, especially force applied at an angle.

Such problems have been recognized in the art and numerous disconnection assistance structures have been proposed. In U.S. Pat. No. 5,964,605 provides an ejector assembly which is carried on the removable connector and which includes a pivoting handle member terminating in a cam surface which abuts against the exterior of a bight of a V-shaped yoke member, the leg ends of which, in turn, abut a fixed surface associated with the mating connector member. In this approach rotation of the cam urges the yoke leg ends against the fixed abutting member. The back pressure against the cam and its attachment point to the connector member is said to result in pushing the cam attached connector member away from contact with the opposed connector member. While such structures may facilitate disconnecting, their mechanical leverage is low and their difficulty of operation may be a concern.

It would therefore be an advance in the art to provide an ejector or connector-separating structure which is easy to operate, provides significant mechanical advantage and utilizes parts which are easily and securely affixed to the connector.

SUMMARY OF THE INVENTION

It is therefore the object of this invention to provide a connector mounted moveable separator mechanism, or ejector, for urging electrical connector housing members apart from one another to, at least, initiate a disconnection movement separating the members.

This object is achieved by the provision of an ejector mechanism consisting of a handle equipped lever which is pivotally attached to a connector housing remote from the connection face. A link is attached to the lever at a point spaced from the lever's pivot so that it undergoes movement when the lever is pivoted. The link terminates in a rotary cam which is pivotally affixed to the connector housing adjacent to, but spaced from, the connector face. The cam is positioned so that when the connector housing is properly mated with a compatible opposed housing, the cam's surface, in a lever storage, not activated, position will engage, or be closely spaced from, an opposed surface of the complimentary mating connector housing. Thereafter, movement of the pivoted lever will cause a rotation of the cam by a drive through the link. The cam is provided with a camming surface having a configuration such that upon pivoting of the cam the complimentary connection's housing engaging point will be moved away from the cam's pivot point thereby separating the housings.

In an embodiment the lever may be attached to a dual leg link which in turn is connected to two cam members positioned on opposite sides of the connector housing. In this manner, movement of the lever will engage cam surfaces on both opposite sides of the housing balancing the separating force.

DESCRIPTION OF THE PREFERRED EMBODIMENT

Figure 1:
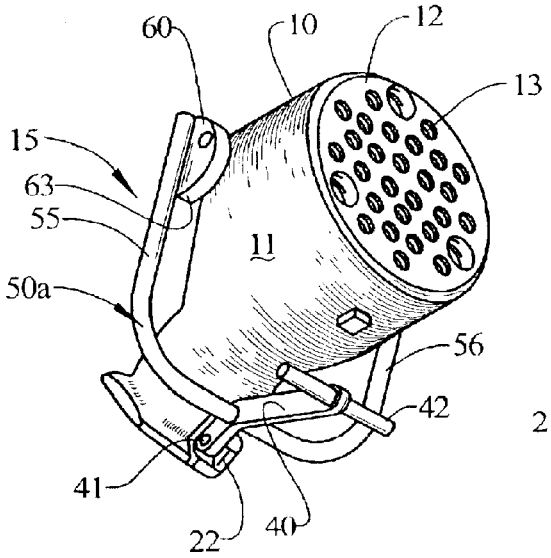
FIG. 1 is a perspective view of a connector housing carrying an ejector.

As shown in FIG. 1 a connector housing 10 includes a housing shell 11 which may, in the embodiment illustrated, be primarily cylindrical, has a connector face 12 at one end of the cylindrical body with the face having a plurality of openings 13 (or pins) therein. The housing shell may be provided with an ejector assembly 15. The connector housing illustrated is of the type frequently used for railroad equipment and is illustrated in a 27 socket face configuration. The connector face may be provided with socket openings as shown or with contact pins depending upon whether the particular housing is intended to be the male or the female component.

As is well known, such housings may be provided with angularly displaced tail sections 20 terminating in a cord connecting end 21 remote from the connector face. Such connector housings are usually multi-component and may be completely internally sealed after the connector elements are positioned. The connector housing illustrated is intended to be inserted into a complimentary housing 30, which is only partially illustrated in the drawings. Such complimentary housings may take many different forms and may, for example, consist of a fixed receptacle connector built into a locomotive or train car.

Common to such complimentary connector sets is that one member is inserted into a housing or surround part of the other member such that one housing has an end face 31 defining an opening receiving the other connector housing or at least a portion thereof.

Figure 2:
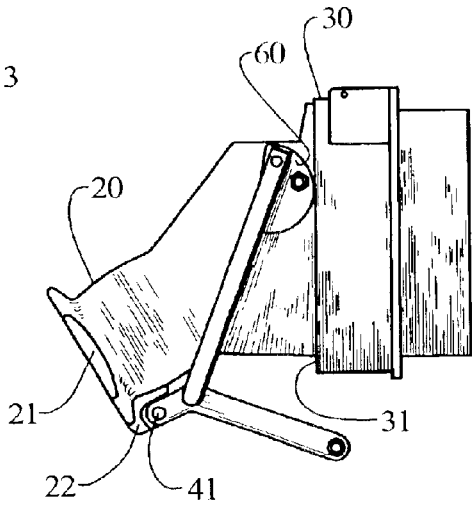
FIG. 2 is a side plan view of an ejector equipped connector housing shown in juxtaposition to a portion of a complimentary connector housing.
Figure 3:
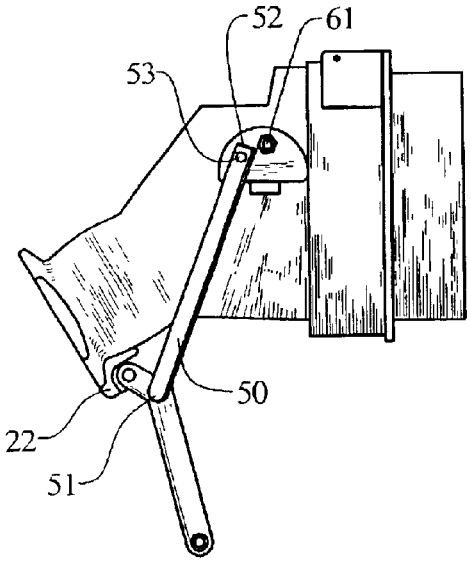
FIG. 3 is a view similar to FIG. 2 showing the ejector assembly activated to urge the connector housings away from one another.

The ejector assembly 15 of this invention includes an angled lever 40 pivotally attached at 41 to a boss 22 attached to, or formed as a part of, the angled section of the housing adjacent to the end 21. The lever 40 may be terminated at its free end in a grasping handle 42 illustrated in the drawings as being a crossbar. Intermediate the ends of the lever, a link 50 has one end 51 thereof pivotally attached to the lever. An opposite end 52 of the link is pivotally attached at 53 to a cam 60. The cam 60 is in turn rotatably carried at 61 by the housing 10. The connection 53 between the link and the cam is offset from the connection of the cam to the housing. In this manner movement of the link causes the cam to rotate about the pivot connection 61. The outer peripheral surface 63 of the cam forms a cam face. When the housing 10 is fully inserted into the complimentary housing 30 and the lever is in its storage position, similar to that shown in FIG. 2, the cam surface will abut the end face 31 of the complimentary housing 30 or will be spaced very closely thereto. Movement of the lever away from the storage position will cause the link to rotate the cam. Rotation of the cam will increase the distance between the cam pivot 61 and the end face 31 thereby forcing a partial withdraw of connector housing 10 from complimentary housing 30.

As shown in the figures, the link may be formed as a generally U-shaped yoke member 50*a* having legs 55 and 56 extending up either opposite side of the connector housing. The connector housing may then be provided with two cams, one on each side, each engaging the end face 31. In this manner actuation of the lever causes a more balanced withdrawal force, urging the connector housings apart.

Although I have chosen to illustrate a cam having a constant curved cam surface, it will be appreciated and understood in the art that many alternative designs for the cam can be provided. The constant curvature surface provides an essentially constant mechanical advantage. Varying curvature surfaces can be used which can provide for a greater range of disconnect motion under cam urging while also providing the greatest mechanical advantage at the start of separation.

In operation the lever will be secured in its storage position by appropriate means such as, for example, a conical spring washer attached to housing 31.

Although I have shown my invention in association with a single preferred embodiment, it will be understood that those with ordinary skill in the art will be able to practice the invention in many variants. For example, the cam could be internal of the connector housing open to the connector face with the link passing through an opening to the housing and connected to the cam interior. In this manner the cam is environmentally protected.

We claim:

1. An ejector assembly for electrical connectors for urging mating connectors bodies apart comprising a connector housing, a lever pivotally attached to the connector housing, a link attached to the lever spaced from the pivotal attachment to the housing, a cam pivotally attached to the housing at a point spaced from the lever attachment, said link positioned exterior of the housing, the link having an attachment to the cam whereby upon movement of the lever the cam is rotated.

2. A device according to claim 1 wherein the cam is positioned on the housing such that a face of the cam providing a cam surface will be adjacent to or in contact with an opposed surface of a mating complimentary connector body when the connector housing and complimentary connector body are in fully seated connection.

3. An electrical connector assembly comprising first and second members adapted to be connected together, a face on the second member, a cam pivotally attached to an exterior surface of the first member at a pivot point and having a cam face opposed to the second member's face when the members are operatively positioned together, the cam rotatable with respect to the first member about the pivot point and having a cam face configuration which changes the distance between the pivot point and the point of cam face contact with the second member's face during rotation of the cam whereby rotation of the cam in one direction will force the second member's face away from the pivot point thereby separating the connectable members, an actuating lever for causing movement of the cam, the lever pivotally carried by the first member at a point spaced from the pivot point, and means connecting the cam to the lever.

4. A device according to claim 3 wherein two cams are provided on the first member each having camming faces contactable with the second member's faces.

5. A device according to claim 4 wherein the means includes a link connection between the pivotal lever and the cams for causing simultaneous rotation of the cams.

* * * * *